US005891607A

United States Patent [19]

Brewer et al.

[11] Patent Number: 5,891,607

[45] **Date of Patent: *Apr. 6, 1999**

[54] COLOR MOTION PICTURE PRINT FILM FOR USE WITH DIGITAL OUTPUT

[75] Inventors: John C. Brewer; James P. Merrill, both of Rochester, N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 929,962

[22] Filed: Sep. 15, 1997

[51] Int. Cl.[6] ..... G03C 1/46; G03C 7/22; G03C 7/407; G03C 5/12

[52] U.S. Cl. ..... 430/383; 430/502; 430/503; 430/567; 430/363

[58] Field of Search ..... 430/502, 503, 430/383, 567, 363

[56] References Cited

U.S. PATENT DOCUMENTS

| | | | |
|---|---|---|---|
| 4,873,428 | 10/1989 | Takeuchi et al. | 250/214 DC |
| 5,012,333 | 4/1991 | Lee et al. | 358/520 |
| 5,300,381 | 4/1994 | Buhr et al. | 430/30 |
| 5,390,036 | 2/1995 | Buhr et al. | 358/519 |
| 5,447,811 | 9/1995 | Buhr et al. | 430/20 |
| 5,514,527 | 5/1996 | Abe et al. | 430/506 |
| 5,528,339 | 6/1996 | Buhr et al. | 355/32 |
| 5,538,839 | 7/1996 | Abe et al. | 430/506 |
| 5,561,012 | 10/1996 | Brewer et al. | 430/21 |

(List continued on next page.)

OTHER PUBLICATIONS

B. Bergery, "Reflections: The Lab, Part II", American Cinematographer, May 1993, pp. 74–78.

J.E. Boyd, "Digital Image Film Generation—From the Photoscientist's Perspective", Journal of Applied Photographic Engineering, vol. 8, 1982, pp. 15–22.

B. Hunt, et al, "High–Resolution Electronic Intermediate System for Motion–Picture Film" SMPTE Journal, Mar. 1991, pp. 156–161.

*Primary Examiner*—Mark F. Huff
*Attorney, Agent, or Firm*—Andrew J. Anderson

[57] ABSTRACT

One embodiment of the invention comprises a silver halide light sensitive photographic print element comprising a support bearing on one side thereof: a blue color sensitive record comprising at least one blue-sensitive silver halide emulsion yellow-image forming layer, a red color sensitive record comprising at least one red-sensitive silver halide emulsion cyan-image forming layer, and a green color sensitive record comprising at least one green-sensitive silver halide emulsion magenta-image forming layer; wherein the overall contrast (OC) of the green record is greater than 1.9, and the mid-scale contrast (MSC) of the green record is about 3.2 or more, wherein the parameters OC and MSC are as defined herein. A further embodiment of the invention comprises a process of forming an image in a motion picture silver halide light sensitive color photographic print element comprising: (a) digitally exposing a photographic light sensitive element according to digital image data using a digital film recording device to form a color negative film record, and printing the negative film record on the silver halide light sensitive photographic print element to form an exposed print element, or (b) directly exposing the silver halide light sensitive photographic print element according to digital image data with a digital film recording device; and processing the exposed photographic print element resulting from (a) or (b) to form a developed image; wherein the overall contrast (OC) of the green record of the print element is greater than 1.9. Preferably, the elements of the invention and the elements used in the process ol the invention have corresponding red and blue OC values which are at least 90% of the green values, and MSC values within ±10% of the green values, enabling the production of outstanding projected images having black densities and with digital assistance, optimal mid-scale contrasts which together cannot be easily obtained with traditionally designed color print films.

18 Claims, 1 Drawing Sheet

U.S. PATENT DOCUMENTS 5,563,027 10/1996 Johnston et al. ..... 430/509
5,574,659 11/1996 Delvers et al. ..... 358/296
5,576,128 11/1996 Keech et al. ..... 430/21
5,674,665 10/1997 Sawyer et al. ..... 430/383
5,705,327 1/1998 Brewer et al. ..... 430/504
5,750,320 5/1998 Bogdanowicz et al. ..... 430/383

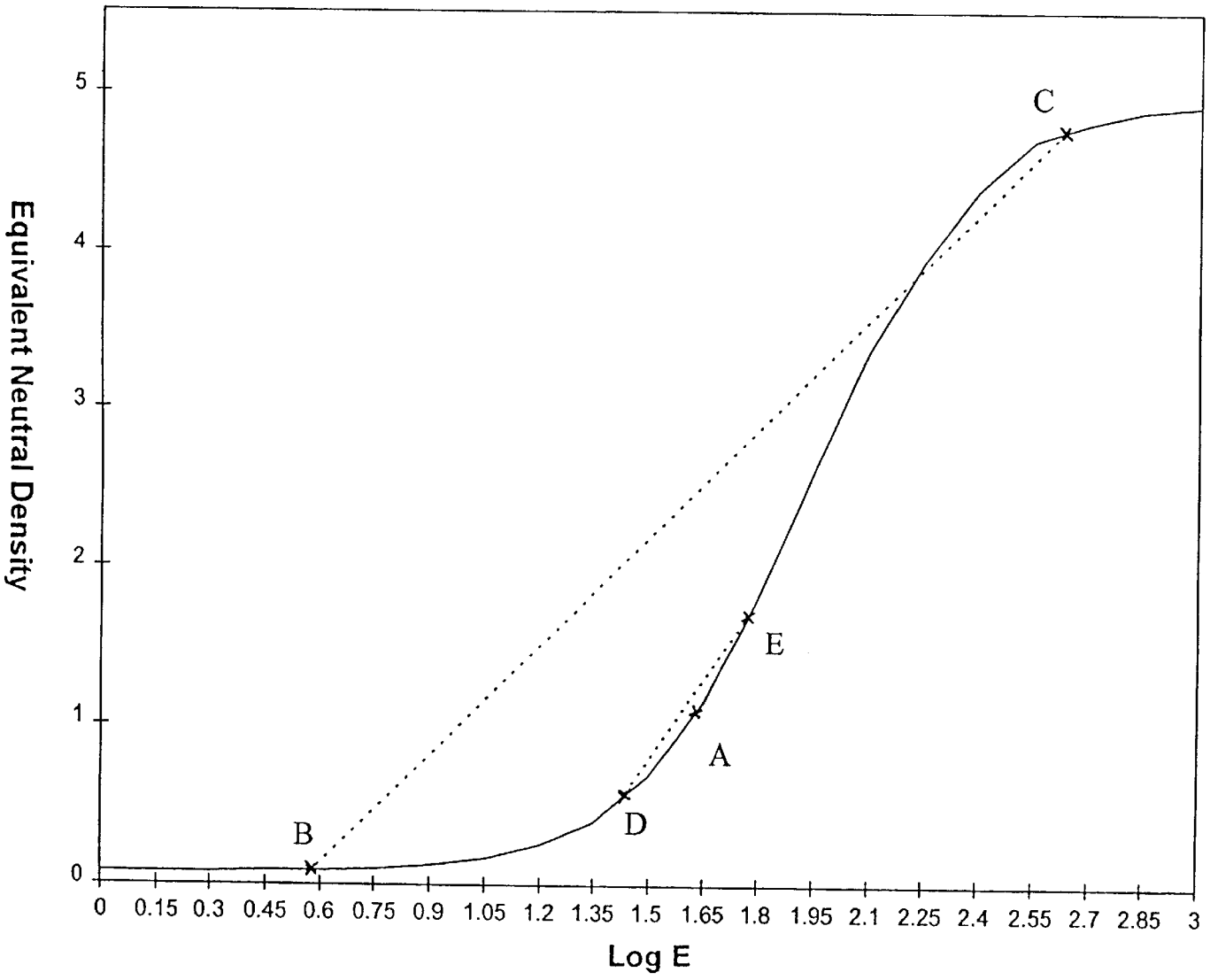
Equivalent Neutral Density
0
1
2
3
4
5
Log E
0
0.15
0.3
0.45
0.6
0.75
0.9
1.05
1.2
1.35
1.5
1.65
1.8
1.95
2.1
2.25
2.4
2.55
2.7
2.85
3
A
B
C
D
E

COLOR MOTION PICTURE PRINT FILM FOR USE WITH DIGITAL OUTPUT

FIELD OF THE INVENTION

The invention relates to a color motion picture print silver halide photographic film, and more particularly to such a film which is enhanced for use with digital film output devices either directly, or as a print material for electronically generated film intermediates or printing masters. The invention expands the range of tone and color reproductions that may be realizable from computer generated images (CGI), digital manipulations of scanned film samples or manipulations of images captured with digital devices.

BACKGROUND

Color negative origination silver halide photographic films are a class of photosensitive materials that map the luminance (neutral) and chrominance (color) information of a scene to complementary tonal and hue polarities in the negative film. Upon exposure and development of the film to form dye images from photographic couplers incorporated in the film, light areas of the scene are recorded as dark areas on the color negative film, and dark areas of the scene are recorded as light areas on the color negative film. Colored areas of the scene are typically recorded as complementary colors in the color negative film: red is recorded as cyan, green is recorded as magenta, blue is recorded as yellow, etc. In order to render an accurate reproduction of a scene, a subsequent process is necessary to reverse the luminance and chrominance information back to those of the original scene. In the motion picture industry, one such subsequent process is to optically print (by contact or optics) the color negative film onto another negative working photosensitive silver halide material which produces dye images upon exposure and development, such as a motion picture silver halide print film, to produce a color positive image suitable for projection.

Historically, color print silver halide photographic materials, such as EASTMAN EXR Color Print Film 5386™, have been optimized to yield pleasing projected prints when used in conjunction with color negative origination silver halide photographic materials as discussed above. That is, the sensitometric properties of print materials are co-optimized by considering the properties of the printing device to be used and the nature of a representative color negative tonescale to be printed, such as that of KODAK VISION 500T Color Negative Film 5279™. When a motion picture color negative is printed on motion picture color print stock, the sensitometric properties of the two materials combine to yield an acceptable scene reproduction in the print film when projected on a theater screen. To facilitate obtaining optimal reproductions, guidelines exist regarding the exposure of the camera original negative (for example see American Cinematographer Manual, Dr. Rod Ryan Ed., $7^{th}$ Edition, The ASC Press, Hollywood, Calif., 1993, pp128–141.), exposure of the print stock (LAD-*Laboratory Aim Density* KODAK Publication No. H-61), and projector/screen luminance levels (Society of Motion Picture and Television Engineers (SMPTE) Standard 196M-1995).

In order to obtain a high quality visual image in an optical photographic print, the contrasts for each color record of the negative film and print film designed for producing optical prints are conventionally maintained within certain ranges (e.g., mid-scale contrasts of about 0.45–0.7 for negative films and about 2.5–3.1 for print films), as too low a contrast may result in production of flat-looking positive print images with black tones rendered as smokey-grey and white tones rendered as light gray, while too high a contrast may result in poor flesh tone reproductions and loss of shadow detail. Pictures such as these would not be pleasing to view and would be deemed to be of low quality in the industry.

Correct exposure of camera negative originals has long been emphasized not only to ensure that critical scene information is properly recorded but also so that when the negative is printed on a photographic print film according to trade practice, scene blacks are sufficiently dense in the resulting projected prints. The importance of obtaining substantial black densities is such that cinematographers often over-expose camera negatives as a means of obtaining good blacks. Dense camera originals require higher light levels to be used in the printing step. When the printing light is increased, the exposure delivered to the photographic print film from the Dmin area of the camera film is higher, resulting in greater dye generation upon photographic processing and resulting higher black densities. This effect is well know in the trade (American Cinematographer Manual, p281). Even with overexposure techniques, however, maximum equivalent neutral (i.e., visual) densities obtainable for conventional silver halide photographic print films are generally limited to about 3.8, where the equivalent neutral density of any particular dye color record is defined as the visual density that results when the other two dyes are added in quantities just sufficient to produce a neutral gray (see, e.g., "Procedures for Equivalent-Neutral-Density (END) Calibration of Color Densitometers Using a Digital Computer", by Albert J. Sant, in the Photographic Science and Engineering, Vol. 14, Number 5, September–October 1970, pg. 356). Over-exposures additionally can result in loss of highlight detail in a resulting print. Additional special image processing techniques are also known in the art for raising black density levels in conventional photographic silver halide print materials, such as by-passing the bleach step present in normal print processing so as to retain developed silver (see, e.g., B. Bergery, "Reflections: The Lab, Part II", American Cinematographer, May 1993, pp. 74–78). The retained silver increases print opacity yielding higher black densities, but with an accompanying loss of color saturation. Additionally, given the need for large throughput in the creation of theatrical release prints, non-standard processing is burdensome and impractical.

Alternatives to silver halide photographic print films are known which provide desirably high print black density levels. Dye imbibition transfer prints, e.g., are able to achieve much higher dynamic ranges than commercially available color-coupled silver halide photographic films. Visual densities as high as 5.0 are possible, while the current color-coupled print films are limited to densities of about 3.8. The imbibition printing process, however, is disadvantageous as it requires the formation of three separation matrix films and complex registration procedures during the transfer of dyes to a receiving blank to form a print film.

Given the desire to have high black densities in projected prints, it would be advantageous to raise the overall contrast of color-coupled silver halide photographic print materials in order to raise the Dmax of such films, by either changing film silver laydown and/or coupler levels or through modification of film processing conditions. Unfortunately, in doing so, the contrast of flesh reproduction would also be typically undesirably raised and image shadow detail may be lost (shadows may be blocked in) upon conventional printing as discussed above. Thus there is an apparent conflict in establishing an optimal contrast level for photographic print stock: to obtain high black densities, the contrast should be at a maximum, but high contrast levels prove to be detrimental to flesh and shadow-detail reproduction. There is a simultaneous need for good blacks and sufficient shadow density. Therefore, for conventional printing, a high contrast print stock would generally not be acceptable.

Processes for inserting a digital image data manipulation step in conventional photographic image generation processes prior to making a final picture print are known in the art. Digital image data, obtained directly or by scanning optical (analog) images with a digital film scanner, can be extensively manipulated, using computer processing and look-up table mapping, before recording back out onto film (see, e.g., U.S. Pat. No. 5,574,659, and J. E. Boyd, J. Appl. Photo. Eng., Vol 8, 1982, pp15–22). In the motion picture industry, such digital image data may conveniently be recorded on a motion picture intermediate negative film, such as EASTMAN Color Intermediate Films 2244, 5244, and 7244, with a digital film recorder such as a CINEON LIGHTING Digital Film Recorder. As discussed in Boyd, special film-reproduction curves can be created to simulate any desired gamma, relative film speed, and/or toe/shoulder responses, and such curves may be implemented using custom look-up tables in film recorders. The reproduction response of digitally exposed film can be completely variable, unlike conventionally exposed film which has a sensitometric response that can be altered only slightly with changes in development time and temperature. The characteristic curve of the film and exposure of the camera film determine the overall density of the final image, with limited changes in contrast and film speed possible during development.

Digital film recorders (e.g. CINEON LIGHTNING Digital Film Recorder), particularly those using lasers as their exposing sources, are capable of creating digital modified negatives (e.g., on EASTMAN Color Intermediate Films 2244, 5244, and 7244) with a dynamic range of 2.0 printing density. In the motion picture industry, however, color photographic silver halide print films which are used in conjunction with digitally created or modified output material are typically the same as those that have been optimized for the direct or release optical printing of color photographic silver halide negative films. Such motion picture silver halide photographic print stocks are accordingly designed with latitudes commensurate for use with typical color negative photographic film dynamic ranges, typically 1.5 printing density or less. The design constraints imposed by the latter use make these print materials sub-optimal for use with digitally output material. As a result, the inherent dynamic range available from film/digital recorder combinations is not fully realizable in projected prints. The upper-scale contrast of conventional photographic silver halide print stock is such that lighter densities on the recorded negative map to a region of decreasing contrast in the print stock, preventing the achievement of high print densities that are desirable for scene blacks. As a result, there is a distinct limitation to the black density that may be achieved, in spite of the insertion of advantageous digital processing steps prior to printing.

It would accordingly be desirable to provide a color-coupled silver halide photographic print film element which would enable higher black densities and improved color saturation when used with digitally created or modified negatives or when exposed directly in laser film recording devices in order to permit the full flexibility and dynamic range inherent in digital processing to be realized in projected photographic prints. It would be further desirable to provide such an element which is robust and easily manufactured, and which may be used in current printers and processors without requiring any modifications to standard exposure and development processes.

SUMMARY OF THE INVENTION

One embodiment of the invention comprises a silver halide light sensitive photographic print element comprising a support bearing on one side thereof: a blue color sensitive record comprising at least one blue-sensitive silver halide emulsion yellow-image forming layer, a red color sensitive record comprising at least one red-sensitive silver halide emulsion cyan-image forming layer, and a green color sensitive record comprising at least one green-sensitive silver halide emulsion magenta-image forming layer; wherein the overall contrast (OC) of the green record is greater than 1.9, preferably greater than or equal to 2.0, and most preferably greater than or equal to 2.2, and the mid-scale contrast (MSC) of the green record is about 3.2 or more, wherein the parameter OC for each of the color records is defined as the slope of a straight line connecting a point B and a point C on the characteristic curve of Equivalent Neutral Density versus log Exposure for the color record, where points B and C are located by defining a point A on the characteristic curve at the log Exposure required to attain a density level of 1.0, and points B and C are located on the characteristic curve at exposure values −1.1 log Exposure and +0.9 log Exposure with respect to point A, respectively, and the parameter MSC is defined as the slope of a straight line connecting a point D and a point E on the characteristic curve for the color record, where points D and E are located at exposure values −0.2 log Exposure and +0.2 log Exposure with respect to point A, respectively.

A further embodiment of the invention comprises a process of forming an image in a motion picture silver halide light sensitive photographic print element comprising: (a) digitally exposing a photographic light sensitive element according to digital image data using a digital film recording device to form a color negative film record, and printing the negative film record on the silver halide light sensitive photographic print element to form an exposed print element, or (b) directly exposing the silver halide light sensitive photographic print element according to digital image data with a digital film recording device; and processing the exposed photographic print element resulting from (a) or (b) to form a developed image; wherein the print element comprises a support bearing on one side thereof: a blue color sensitive record comprising at least one blue-sensitive silver halide emulsion yellow-image forming layer, a red color sensitive record comprising at least one red-sensitive silver halide emulsion cyan-image forming layer, and a green color sensitive record comprising at least one green-sensitive silver halide emulsion magenta-image forming layer; wherein the overall contrast (OC) of the green record is greater than 1.9, preferably greater than or equal to 2.0, and most preferably greater than or equal to 2.2, wherein the parameter OC for each of the color records is defined as the slope of a straight line connecting a point B and a point C on the characteristic curve of Equivalent Neutral Density versus log Exposure for the color record, where points B and C are located by defining a point A on the characteristic curve at the log Exposure required to attain a density level of 1.0, and points B and C are located on the characteristic curve at exposure values −1.1 log Exposure and +0.9 log Exposure with respect to point A, respectively.

Preferably, the elements of the invention and the elements used in the process of the invention have corresponding red and blue OC values which are at least 90% of the green values, and MSC values within ±10% of the green values, enabling the production of outstanding projected images having black densities and with digital assistance, optimal mid-scale contrasts which together cannot be easily obtained with traditionally designed color print films.

ADVANTAGES

We have found that color print film silver halide photographic elements with Overall Contrast (OC) values above those of conventional color print films can be used in conjunction with digital recorder output and show benefits not previously available. We have found that color print films having OC in the green record greater than 1.9, more preferably greater than or equal to 2.0 and most preferably greater than 2.2, and preferably also having corresponding red and blue values which are at least 90% of the green values, enable the production of outstanding projected images having black densities and optimal mid-scale contrasts that cannot be obtained with traditionally designed color print films. Additionally, films with high OC values and also relatively high mid-scale contrast (MSC) values which result in traditional S-shaped characteristic curves have additional benefits resulting from their simple formulations. Due to the relatively high mid-scale contrast in accordance with print elements of the invention, however, pleasing projected prints are generally not possible without an intervening digital processing step. The sensitometric short-comings can be compensated for by way of digital look-up tables (LUTS). This results in the added benefit of manufacturing ease, as S-shaped curves can be obtained with one or two emulsions per color record whereas highly non-linear sensitometric curves typically require more complex film structures. The invention provides high dynamic range display capability for electronically modified or originated images in a light sensitive silver halide photographic motion picture print material.

BRIEF DESCRIPTION OF THE DRAWINGS

FIG. 1 contains a Density versus Log Exposure plot for a standard 0–3 sensitometric exposure of a print film in accordance with the invention and illustrates how the parameters OC and MSC are determined.

DETAILED DESCRIPTION OF THE INVENTION

The photographic print film elements of the present invention are color elements and contain dye image-forming units sensitive to each of the three primary regions of the spectrum, i.e. blue (about 400 to 500 nm), green (about 500 to 600 nm), and red (about 600 to 760 nm) sensitive image dye-forming units. Each unit can be comprised of a single emulsion layer or of multiple emulsion layers sensitive to a given region of the spectrum. The layers of the element, including the layers of the image-forming units, can be arranged in various orders as known in the an. In an alternative, less preferred, format, the emulsions sensitive to each of the three primary regions of the spectrum can be disposed as a single segmented layer.

A typical multicolor photographic print element comprises a support bearing a yellow dye image-forming unit comprising at least one blue-sensitive silver halide emulsion layer having associated therewith at least one yellow dye-forming coupler, a cyan dye image-forming unit comprised of at least one red-sensitive silver halide emulsion layer having associated therewith at least one cyan dye-forming coupler, and a magenta dye image-forming unit comprising at least one green-sensitive silver halide emulsion layer having associated therewith at least one magenta dye-forming coupler. Each of the cyan, magenta, and yellow image forming units may be comprised of a single light-sensitive layer, a pack of two light-sensitive layers with one being more light sensitive and the other being less light-sensitive, or a pack of three or more light-sensitive layers of varying light-sensitivity. These layers can be combined in any order depending upon the specific features designed in the photographic element. The element can contain additional layers, such as filter layers, interlayers, overcoat layers, subbing layers, antihalation layers, antistatic layers, and the like.

We have found that by designing films with overall contrast (OC) and mid-scale contrast (MSC) values above those of conventional optically projectable color print films, we obtain benefits previously not available. While the increase in mid and upper-scale contrasts accompanying these changes would result in print stocks which are generally unable to provide pleasing projected prints when used in conjunction with conventionally exposed color negative films (flesh tones would be reproduced at high contrast levels and shadow detail would be lost or blocked in), when used in conjunction with digitally created negatives or when directly digitally exposed the films of the invention are capable of obtaining a wider range of print densities than that of any conventional silver halide photographic motion picture films.

The parameter OC for each of the color records of a print element is determined by locating the log exposure value associated with 1.0 Equivalent Neutral Density on the characteristic curve (point A on the curve, corresponding to a normally exposed 18% gray card) for the record and establishing a point B on the curve, 1.1 log E lower in value and a point C on the curve, 0.9 log E higher in exposure. (This log E range corresponds to the 2.0 printing density range currently possible with commercial laser film recorders.) OC is the two point contrast line BC. The mid-scale contrast value, MSC, which assesses the suitability of the stock for conventional printing, is determined by establishing a point D on the curve, 0.2 log E lower in value than point A, and a point F on the curve, 0.2 log E higher in exposure than point A. MSC is simply the two point contrast line DE. Points D and E approximate the print densities for grays I-stop above and below a normally exposed 18% gray.

Color print films designed for use with conventionally exposed negatives and projection viewing generally provide OC values for each of their color records of about 1.8 or less, typically about 1.7, and green MSC of about 3.15 or less, typically about 2.85, in order to yield pleasing projected prints from color negative origination films (red and blue MSC values are typically ±10% of green MSC values). Under standard projection conditions, black Equivalent Neutral Densities (i.e., visual densities) in excess of 3.5 are perceived as outstanding but these are for all practical purposes unobtainable in the conventional process due to the contrast levels of camera original negatives and the sensitometric properties of color-coupled print stock.

In constructing films according to the invention, the required parameters can be achieved by various techniques, examples of which are described below. These techniques are preferably applied to each color record of a silver halide photographic element so that all color records will meet the requirements of the present invention. For example, the contrast position exhibited in films according to the invention may be accomplished by any combination of formulations changes such as increased laydowns of silver or image coupler, blend ratio changes of high and low speed emulsions, decreased laydowns of image modifying chemistry such as development inhibitor releasing (DIR) or development inhibitor anchimeric releasing (DIAR) couplers, and blend ratio changes of more-active and less-active image couplers. All of these film design tools are well known in the art.

The inherent versatility of digital tonescale manipulation previously recognize by others can be realized with the inventive print films of high OC contrast levels. This has been observed with scenes that have been manipulated through various look-up tables (LUTs) to yield reproductions with optimal mid-scale contrasts and high black density levels.

In the following discussion of suitable materials for use in the emulsions and elements that can be used in conjunction with the invention, reference will be made to *Research Disclosure*, September 1994, Item 36544, available as described above, which will be identified hereafter by the term "*Research Disclosure*." The contents of the *Research Disclosure*, including the patents and publications referenced therein, are incorporated herein by reference, and the Sections hereafter referred to are Sections of the *Research Disclosure*, Item 36544.

The silver halide emulsions employed in the elements of this invention will be negative-working emulsions. Suitable silver halide emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing conditions can be found in Sections XI–XX.

It is also contemplated that the materials and processes described in an article titled "Typical and Preferred Color Paper, Color Negative, and Color Reversal Photographic Elements and Processing," published in *Research Disclosure*, February 1995, Item 37038 also may be advantageously used with elements of the invention. It is further specifically contemplated that the print elements of the invention may comprise antihalation and antistatic layers and associated compositions as set forth in U.S. Pat. Nos. 5,723,272, 5,650,265, and 5,679,505, the disclosures of which are incorporated by reference herein.

Photographic light-sensitive print elements of the invention may utilize silver halide emulsion image forming layers wherein chloride, bromide and/or iodide are present alone or as mixtures or combinations of at least two halides. The combinations significantly influence the performance characteristics of the silver halide emulsion. Print elements are typically distinguished from camera negative elements by the use of high chloride (e.g., greater than 50 mole % chloride) silver halide emulsions containing no or only a minor amount of bromide (typically 10 to 40 mole %), which are also typically substantially free of iodide. As explained in Atwell, U.S. Pat. No. 4,269,927, silver halide with a high chloride content possesses a number of highly advantageous characteristics. For example, high chloride silver halides are more soluble than high bromide silver halide, thereby permitting development to be achieved in shorter times. Furthermore, the release of chloride into the developing solution has less restraining action on development compared to bromide and iodide and this allows developing solutions to be utilized in a manner that reduces the amount of waste developing solution. Since print films are intended to be exposed by a controlled light source, the imaging speed gain which would be associated with high bromide emulsions and/or iodide incorporation offers little benefit for such print films.

Photographic print elements are also distinguished from camera negative elements in that print elements typically comprise only fine silver halide emulsions comprising grains having an average equivalent circular diameter (ECD) of less than about I micron, where the ECD of a grain is the diameter of a circle having the area equal to the projected area of a grain. The ECDs of silver halide emulsion grains are usually less than 0.60 micron in red and green sensitized layers and less than 0.90 micron in blue sensitized layers of a color photographic print element. Such fine grain emulsions used in print elements generally have an aspect ratio of less than 1.3, where the aspect ratio is the ratio of a grain's ECD to its thickness, although higher aspect ratio grains may also be used. Such grains may take any regular shapes, such as cubic, octahedral or cubo-octahedral (i.e., tetradecahedral) grains, or the grains can take other shapes attributable to ripening, twinning, screw dislocations, etc. Typically, print element emulsions grains are bounded primarily by {100} crystal faces, since {100} grain faces are exceptionally stable. Specific examples of high chloride emulsions used for preparing photographic prints are provided in U.S. Pat. Nos. 4,865,962; 5,252,454; and 5,252,456, the disclosures of which are here incorporated by reference.

Photographic print films which comprise relatively small grain, high chloride emulsions (e.g., emulsions having average grain size equivalent circular diameters of less than about I micron and halide contents of greater than 50 mole % chloride) as discussed above in order to optimize print image quality and enable rapid processing typically result in relatively low speed photographic elements in comparison to camera negative origination films. Low speed is compensated for by the use of relatively high intensity print lamps or lasers for exposing such print elements. For comparison purposes, it is noted that motion picture color print films, e.g., when rated using the same international standards criteria used for rating camera negative films, would typically have an ISO speed rating of less than 10, which is several stops slower than the slowest camera negative films in current use.

Couplers that may be used in the elements of the invention can be defined as being 4-equivalent or 2-equivalent depending on the number of atoms of $Ag^+$ required to form one molecule of dye. A 4-equivalent coupler can generally be converted into a 2-equivalent coupler by replacing a hydrogen at the coupling site with a different coupling-off group. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in U.K. Patents and published Application Nos. 1,466,728; 1,531,927; 1,533,039; 2,006,755A and 2,017,704A, the disclosures of which are incorporated herein by reference.

Image dye-forming couplers may be included in elements of the invention such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler-Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948.

Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler-Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent Applications 176,804; 177,765; U.S. Pat. Nos. 4,659,652; 5,066,575; and 5,250,400.

Couplers that form yellow dyes upon reaction with oxidized color developing agent and which arc useful in elements of the invention are described in such representative patents and publications as: U.S. Pat. Nos. 2,875,057; 2,407,210; 3,265,506; 2,298,443; 3,048,194; 3,447,928 and "Farbkuppler-Eine Literature Ubersicht," published in Agfa Mitteilungen, Band III, pp. 112–126 (1961). Such couplers arc typically open chain ketomethylene compounds. Also preferred are yellow couplers such as described in, for example, European Patent Application Nos. 482,552; 510,535; 524,540; 543,367; and U.S. Pat. No. 5,238,803.

To control the migration of various components coated in a photographic layer, including couplers, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to a polymeric backbone.

It may be useful to use a combination of couplers any of which may contain known ballasts or coupling-off groups such as those described in U.S. Pat. Nos. 4,301,235; 4,853,319 and 4,351,897.

If desired, the photographic elements of the invention can be used in conjunction with an applied magnetic layer as described in *Research Disclosure*, November 1992, Item 34390 published by Kenneth Mason Publications, Ltd., Dudley House, 12 North Street, Emsworth, Hampshire P010 7DQ, ENGLAND.

Photographic elements of the present invention are motion picture print film elements. Such elements typically have a width of up to 100 millimeters (or only up to 70 or 50 millimeters), and a length of at least 30 meters (or optionally at least 100 or 200 meters). In motion picture printing, there are usually three records to record in the image area frame region of a print film, i.e., red, green and blue. The original record to be reproduced is preferably an image composed of sub-records having radiation patterns in different regions of the spectrum. Typically it will be a multicolor record composed of sub-records formed from cyan, magenta and yellow dyes. The principles by which such materials form a color image are described in James, The Theory of the Photographic Process, Chapter 12, Principles and Chemistry of Color Photography, pp 335–372, 1977, Macmillan Publishing Co. New York. Materials in which such images are formed can be exposed to an original scene in a camera, or can be duplicates formed from such camera origination materials, e.g., records formed in color negative intermediate films such as those identified by the tradenames Eastman Color Intermediate Films 2244, 5244 and 7244. Alternatively, the original record may be in the form of electronic image data, which may be used to control a printer apparatus, such as a laser printer, for selective imagewise exposure of a print film in accordance with the invention.

In accordance with the process of the invention, print films are exposed either directly in accordance with digitally generated or modified electronic image data, or through a negative photographic record which has been exposed in accordance with digitally generated or modified electronic image data. In the latter case, the elements of the present invention may be optically exposed to the negative photographic record under normal printing conditions which may be indicated with the film or other manufacturer recommendations, and in both cases the exposed print film may be processed according to standard processing conditions indicated with the film or its packaging. This is advantageous in that the film user need not experiment with various development or print exposing conditions in order to obtain a desired contrast position, as the ultimate contrast in the resulting print film may be controlled by digitally controlling the exposure of the negative photographic record. The film of the present invention is preferably simply printed and processed according to standard procedures, and the advantages of the film are obtained. Alternative processing techniques, however, can also be used with films according to the invention if desired.

By "indicated" in relation to the film printing and processing conditions, means that some designation is provided on the film or its packaging or associated with one or the other, which allows the user to ascertain the manufacturer's recommended printing and/or film processing conditions. Such a designation can be an actual statement ol the recommended printing or processing conditions or reference to a well-known standard method (for example, the Kodak ECP-2B process for motion picture print films). Alternatively, such a designation can be a film identification designation (such as a number or film name) which allows a user to match the film with the manufacturer's recommended printing or processing conditions (such as from a catalogue, brochure or other source).

The following examples illustrate preparation of photographic elements of the present invention, and their beneficial characteristics.

EXAMPLE 1

A multilayer composition for a comparison print element having relatively low OC and MSC values in accordance with prior art practice was prepared by coating the following layers on a gelatin subbed polyethylene terephthalate support with rem-jet carbon black containing backing layer (Element 101). A multilayer photographic print element having relatively high OC and MSC values in accordance with one embodiment of the invention (Element 102) was also prepared by generally increasing the silver and coupler laydown levels as indicated. All units unless otherwise specified are in mg/m$^2$:

| | Element 101 | Element 102 |
|---|---|---|
| Sixth Layer: Protective Overcoat Layer | | |
| Pol (dimethyl siloxane) 200-CS | 26 | 26 |
| PoIy(methyl methacrylate) beads | 5.3 | 5.3 |
| Gelatin | 976 | 976 |
| Spreading aids | | |
| Fifth Layer: Green Sensitized Layer | | |
| AgClBr cubic grain emulsion, 25% Br, 0.15 micron, spectrally sensitized with green dye cpd 1, 0.5273 mmole/Ag mole, and supersensitizer cpd 2, 1.1212 mmole/Ag mole, | 236 | 335 |
| AgClBr cubic grain emulsion, 25% Br, 0.15 micron, spectrally sensitized with green dye cpd 1, 0.5273 mmole/Ag mole, and supersensitizer cpd 2, 1.1770 mmole/Ag mole, | 174 | 247 |
| AgClBr cubic grain emulsion, 25% Br, 0.24 micron, spectrally sensitized with green dye cpd 1, 0.4785 mmole/Ag mole, and supersensitizer cpd 2, 1.3902 mmole/Ag mole, | 25 | 35 |
| Magenta dye forming coupler M-1 | 700 | 994 |
| Oxidized developer scavenger cpd 3 | 56 | 80 |
| Soluble green filter dye 1 | 40 | 57 |
| Soluble green filter dye 2 | 2.9 | 4.1 |
| Gelatin | 1965 | 2791 |
| Fourth Layer: Interlayer | | |
| Oxidized developer scavenger cpd 3 | 79 | 79 |
| Gelatin | 610 | 610 |
| Spreading aids | | |
| Third Layer: Red Sensitized Layer | | |
| AgClBr cubic grain emulsion, 25% Br, 0.15 micron, spectrally sensitized with red dye cpd 4, 0.1808 mmole/Ag mole, supersensitizer cpd 2, 0.6327 mmole/Ag mole | 415 | 569 |
| AgClBr cubic grain emulsion, 25% Br, 0.24 micron, spectrally sensitized with red dye cpd 4, 0.1356 mmole/Ag mole, supersensitizer cpd 2, 0.7444 mmole/Ag mole | 24 | 33 |
| Cyan dye forming coupler (C-1) | 958 | 1313 |
| Oxidized developer scavenger cpd 3 | 12 | 15 |
| Soluble red filter dye 3 | 105 | 135 |
| Gelatin | 3580 | 4905 |
| Second Layer: Interlayer | | |
| Oxidized developer scavenger cpd 3 | 79 | 158 |
| Gelatin | 610 | 1220 |
| Spreading aids | | |
| First Layer: Blue Sensitized Layer | | |
| AgCl cubic grain emulsion, 0.58 micron, spectrally sensitized with blue dye cpd 7, 0.3336 mmole/Ag mole | 676 | 1171 |
| AgCl cubic grain emulsion, 0.76 micron, spectrally sensitized with blue dye cpd 7, 0.2669 mmole/Ag mole | 225 | 0 |
| Yellow dye forming coupler (Y-1) | 1884 | 2449 |
| Yellow dye cpd 8 | 22 | 0 |
| Soluble blue filter dye 4 | 16 | 21 |
| Sequestrant cpd 9 | 323 | 420 |

-continued

| | Element 101 | Element 102 |
|---|---|---|
| Sequestrant cpd 10 | 36 | 46 |
| Gelatin | 3546 | 4610 |
| Support: | | |
| Transparent polyethylene terephthalate support with rem-jet carbon black pigmented, nongelatin layer on the back of the film base which provides antihalation and antistatic properties | | |

A second multilayer photographic print element (Element 103) having relatively high OC values which may be used in the processes in accordance with the invention was prepared by coating the following layers on a gelatin subbed polyethylene terephthalate support. Element 103, however, is designed with three emulsion blends in each of the color records to maintain relatively low MSC values to also enable pleasing prints from negative film records obtained without any digital manipulation.

| | Element 103 |
|---|---|
| Seventh Layer: Protective Overcoat Layer | |
| Poly (dimethyl siloxane) 200-CS | 16.5 |
| Poly (methyl methacrylate) beads | 16.0 |
| Gelatin | 975.9 |
| Spreading aids | |
| Sixth Layer: Green Light-Sensitive Layer | |
| AgClBr cubic grain emulsion, 1.35% Br, 0.11 micron, spectrally sensitized with green dye cpd 11, 0.650 mmole/Ag mole, and green dye cpd 12, 0.014 mmole/Ag mole | 395.2 |
| AgClBr cubic grain emulsion, 2.1% Br, 0.14 micron, spectrally sensitized with green dye cpd 11, 0.505 mmole/Ag mole, and green dye cpd 12, 0.009 mmole/Ag mole | 119.8 |
| AgClBr cubic grain emulsion, 1.9% Br, 0.21 micron, spectrally sensitized with green dye cpd 11, 0.340 mmole/Ag mole, and green dye cpd 12, 0.006 mmole/Ag mole | 83.8 |
| Magenta dye forming coupler M-1 | 904.8 |
| Soluble green filter dye 1 | 90.4 |
| Gelatin | 2033.6 |
| Fifth Layer: Interlayer | |
| Oxidized developer scavenger cpd 3 | 86.1 |
| Gelatin | 610.0 |
| Fourth Layer: Red Light-Sensitive Layer | |
| AgClBr cubic grain emulsion, 1% Br, 0.11 micron, spectrally sensitized with red dye cpd 13, 0.042 mmole/Ag mole | 420.3 |
| AgClBr cubic grain emulsion, 0.9% Br, 0.14 micron, spectrally sensitized with red dye cpd 13, 0.051 mmole/Ag mole | 155.9 |
| AgClBr cubic grain emulsion, 0.6% Br, 0.21 micron, spectrally sensitized with red dye cpd 13, 0.043 mmole/Ag mole | 101.7 |
| Cyan dye forming coupler (C-2) | 1242.8 |
| Soluble red filter dye Pina ™ Filter Dye Blue Green (Riedel-de Haen Company) | 90.4 |
| Gelatin | 4270.6 |
| Third Layer: Interlayer | |
| Oxidized developer scavenger cpd 3 | 86.1 |
| Gelatin | 610.0 |
| Second Layer: Blue Light-Sensitive Layer | |
| AgCl cubic grain emulsion, 0.28 micron, spectrally sensitized with blue dye cpd 14, 0.078 mmole/Ag mole, spectrally sensitized with blue dye cpd 15, 0.079 mmole/Ag mole | 159.3 |

-continued

| | Element 103 |
|---|---|
| AgCl cubic grain emulsion, 0.56 micron, spectrally sensitized with blue dye cpd 14, 0.111 mmole/Ag mole, spectrally sensitized with blue dye cpd 15, 0.113 mmole/Ag mole | 531.0 |
| AgCl cubic grain emulsion, 0.73 micron, spectrally sensitized with blue dye cpd 14, 0.122 mmole/Ag mole, spectrally sensitized with blue dye cpd 15, 0.124 mmole/Ag mole | 371.7 |
| Yellow dye forming coupler (Y-2) | 1468.7 |
| Soluble blue filter dye 4 | 48.0 |
| Sequestrant cpd 9 | 321.1 |
| Sequestrant cpd 10 | 105.0 |
| Gelatin | 2599.0 |
| First Layer: Antihalation Layer | |
| Antihalation Filter Dye cpd 16 | 43.0 |
| Antihalation Filter Dye cpd 17 | 172.2 |
| Gelatin | 758.6 |
| Spreading aids | |
| Support: | |
| Transparent polyethylene terephthalate support | |

Each element also contained bis-vinylsulfonylmethane (BVSM) as a gelatin hardener. Couplers were dispersed with high-boiling coupler solvents and/or auxiliary solvents in accordance with conventional practice in the art.

The above film samples 101, 102 and 103, and two additional commercially available motion picture color print films (Elements 104 and 105) were exposed through a 0–3 density 21-step tablet on a Kodak 1B sensitometer with a 3200 K light source, and processed according to the standard Kodak ECP-2B Color Print Development Process as described in the Kodak H-24 Manual, "*Manual for Processing Eastman Motion Picture Films*", Eastman Kodak Company, Rochester, N.Y., the disclosure of which is incorporated by reference herein, with the exception that those steps specific to sound track development were omitted. Exposures were adjusted so that upon standard processing a middle (e.g., 11th) step achieved Red, Green, Blue Equivalent Neutral Density of 1.0, 1.0, 1.0. The process consisted of a prebath (10"), water rinse (20"), color developer (3'), stop bath (40"), first wash (40"), first fix (40"), second wash (40"), bleach (1'), third wash (40"), second fix (40"), fourth wash (1'), final rinse (10"), and then drying with hot air.

| The ECP-2B Prebath consists of: | |
|---|---|
| Water | 800 mL |
| Borax (decahydrate) | 20.0 g |
| Sodium sutfate (anhydrous) | 100.0 g |
| Sodium hydroxide | 1.0 g |
| Water to make 1 liter | |
| pH @ 26.7° C. is 9.25 +/− 0.10 | |
| The ECP-2B Color Developer consists of: | |
| Water | 900 mL |
| Kodak Anti-Calcium, No.4 (40% solution of a pentasodium salt of nitrilo-tri(methylene phosphonic acid) | 1.00 mL |
| Sodium sulfite (anhydrous) | 4.35 g |
| Sodium bromide (anhydrous) | 1.72 g |
| Sodium carbonate (anhydrous) | 17.1 g |
| Kodak Color Developing Agent, CD-2 | 2.95 g |
| Sulfuric acid (7.0N) | 0.62 mL |
| Water to make 1 liter | |
| pH @ 26.7° C. is 10.53 +/− 0.05 | |
| The ECP-2B Stop Bath consists of: | |
| Water | 900 mL |
| Sutfuric acid (7.0N) | 50 mL |
| Water to make 1 liter | |
| pH @ 26.7° C. is 0.90 | |

-continued

| The ECP-2B Fixer consists of: | |
|---|---|
| Water | 800 mL |
| Ammonium thiosulfate (58.0% solution) | 100.0 mL |
| Sodium bisulfate (anhydrous) | 13.0 g |
| Water to make 1 liter | |
| pH @ 26.7° C. is 5.00 +/− 0.15 | |
| The ECP-2B Ferricyanide Bleach consists of: | |
| Water | 900 mL |
| Potassium ferricyanide | 30.0 g |
| Sodium bromide (anhydrous) | 17.0 g |
| Water to make 1 liter | |
| pH @ 26.7° C. is 6.50 +/− 0.05 | |
| The Final Rinse solution consists of: | |
| Water | 900 mL |
| Kodak Photo-Flo 200 (TM) Solution | 3.0 mL |
| Water to make 1 liter | |

Processing of the exposed elements was done with the color developing solution adjusted to 36.7° C. The stopping, fixing, bleaching, washing, and final rinsing solution temperatures were adjusted to 26.7° C.

The films were then read for Status A densitometry, and converted to equivalent neutral densitometry using the method as described in the article "Procedures for Equivalent-Neutral-Density (END) Calibration of Color Densitometers Using a Digital Computer", by Albert J. Sant, in the Photographic Science and Engineering, Vol. 14, Number 5, September–October 1970, pg. 356–362. The Equivalent Neutral Densities were graphed vs. log (exposure) to form Red, Green, and Blue D-LogE characteristic curves for each of the Elements, and overall contrast (OC) and mid-scale contrast (MSC) values were determined for each color record.

Table 1 summarizes the overall contrast of the print materials. The overall contrast (OC) being defined as follows: OC=(Equivalent Neutral Density at +0.9 log E from 1.0 END)−(Equivalent Neutral Density at −1.1 log E from 1.0 END)/2.0 Log E. The Equivalent Neutral Density (END) at 0.9 log E exposure over the exposure required for 1.0 END is also indicated for each color record.

TABLE 1

| | OC Values | | | END @ +0.9 log E from 1.0 END | | |
|---|---|---|---|---|---|---|
| Element | Red | Green | Blue | Red | Green | Blue |
| 101 | 1.68 | 1.66 | 1.73 | 3.44 | 3.4 | 3.63 |
| 102 | 2.10 | 2.27 | 2.18 | 4.3 | 4.63 | 4.45 |
| 103 | 2.19 | 2.24 | 2.22 | 4.45 | 4.59 | 4.61 |
| 104 | 1.68 | 1.82 | 1.45 | 3.44 | 3.73 | 3.04 |
| 105 | 1.66 | 1.73 | 1.56 | 3.41 | 3.55 | 3.27 |

The high OC values and corresponding high END values at 0.9 log E above 1.0 END for elements 102 and 103 make such films particularly suitable for use with digitally created or modified image data, as such films may be used to take full advantage of the 2.0 dynamic printing density range possible with negative film records created with digital film recorders in accordance with processes of the invention. Elements 101, 104 and 105 are illustrative of conventional silver halide photographic print films optimized for traditional printing of camera negatives. The relatively low OC values and END values at 0.9 log E above 1.0 END result in films which are unable to take full advantage of a 2.0 dynamic printing density range.

Table 2 summarizes the mid-scale contrast (MSC) for each of the print elements. Mid-scale contrast is defined as MSC=(Equivalent Neutral Density at 0.2 log E from 1.0 END)−(Equivalent Neutral Density at −0.2 log E from 1.0 END)/0.4 Log E.

TABLE 2

| | MSC Values | | | | |
|---|---|---|---|---|---|
| Element | Red | Green | Blue | R/G | B/G |
| 101 | 3.21 | 2.88 | 2.63 | 1.11 | 0.91 |
| 102 | 3.53 | 3.38 | 3.03 | 1.04 | 0.90 |
| 103 | 3.23 | 2.73 | 2.78 | 1.18 | 1.02 |
| 104 | 3.28 | 3.15 | 2.80 | 1.04 | 0.89 |
| 105 | 3.00 | 2.83 | 2.63 | 1.06 | 0.93 |

Element 102 exhibits relatively high MSC values in addition to high OC values in accordance with one embodiment of the invention. While such films are advantageous with respect to ease of manufacture and robustness, such films in general will not produce a desirable reproduction when used as a traditional print stock in combination with a conventionally exposed and processed color negative film record, as flesh tones would appear too harsh due to the high mid-scale contrast. For the printing of images which have undergone digital manipulation in accordance with the invention, however, such films may be used to result in pleasing print images as the digital data for such images may be modified through use of look-up tables to compensate for the relatively high mid-scale contrast.

Element 103 satisfies the necessary OC criterion for use in processes in accordance with the invention, but is also formulated to maintain a relatively low mid-scale contrast similar to conventional film Elements 101, 104 and 105 optimized for traditional printing of camera negatives. While beneficial for conventional optical printing of non-digitally created or modified color negative records, the curve shape defined by a high overall contrast and a relatively low mid-scale contrast for such film is not required for the printing of images which have undergone digital manipulation, as the digital data for such images may be modified through use of look-up tables to compensate for a relatively high mid-scale contrast to result in pleasing print images. In fact, such a curve shape may require the use ol three or more emulsions per color record in order to obtain such combination of contrasts, an unnecessary complexity for this application.

The following structures represent compounds utilized in the above described photographic elements.

green sensitizing dye cpd 1

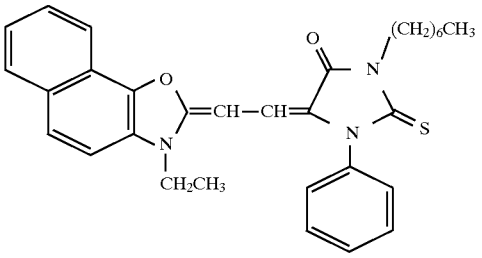

supersensitizer cpd 2

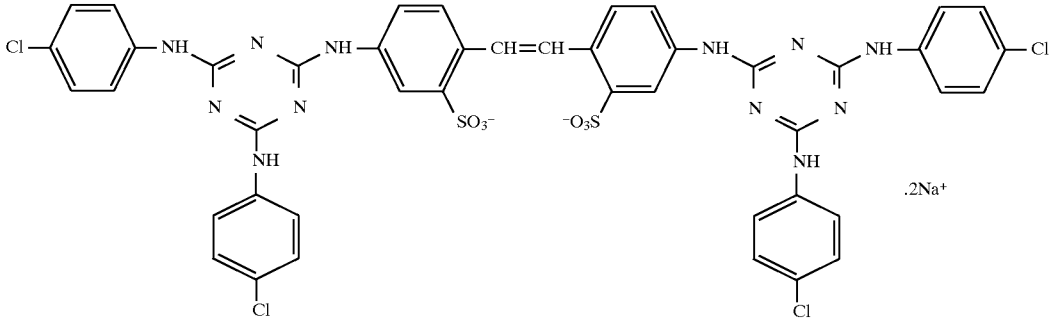

magenta coupler M-1

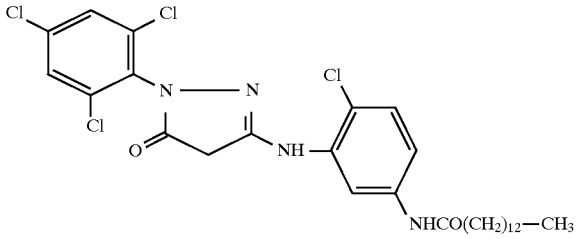

-continued
scavenger cpd 3
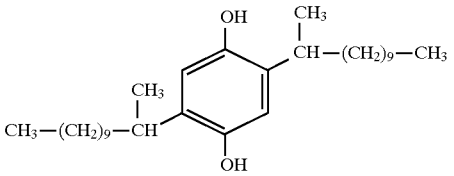
soluble green filter dye #1
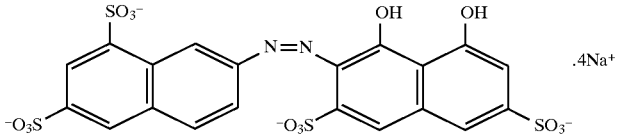
soluble green filter dye #2
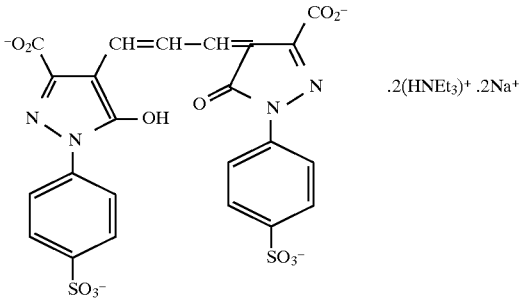
red sensitizing dye cpd 4
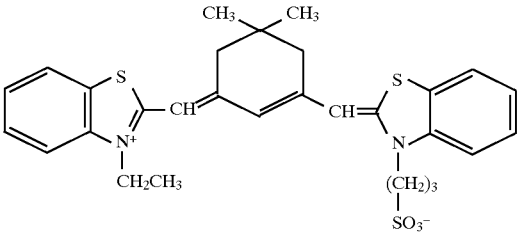
cyan coupler C-1
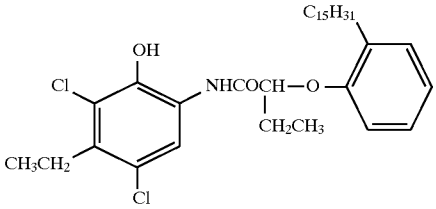
soluble red filter dye #3
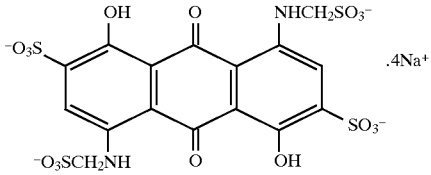
blue sensitizing dye cpd 7
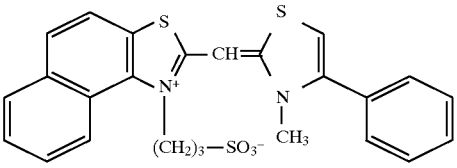

-continued
yellow coupler Y-1
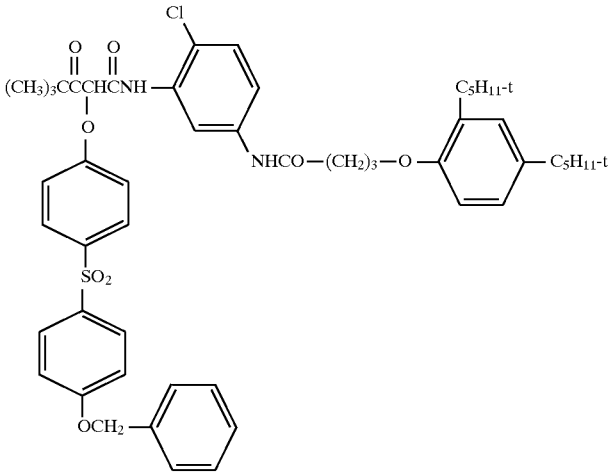
yellow dye cpd 8
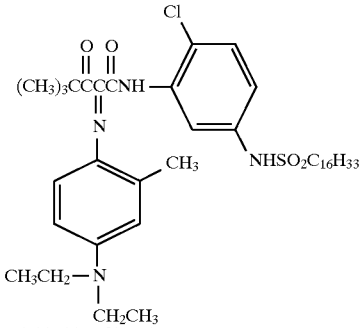
soluble blue filter dye 4
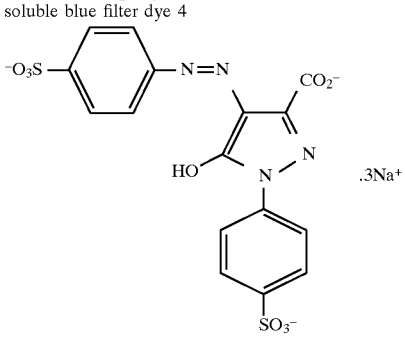
sequestrant cpd 9
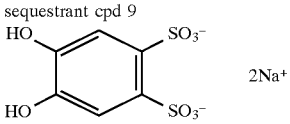
sequestrant cpd 10
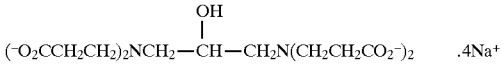
green sensitizing dye cpd 11
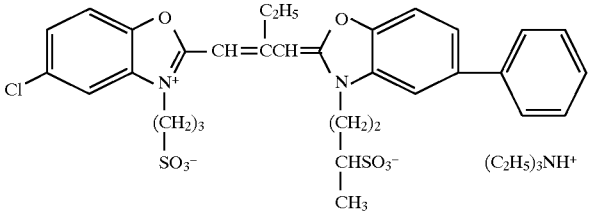

-continued
green sensitizing dye cpd 12
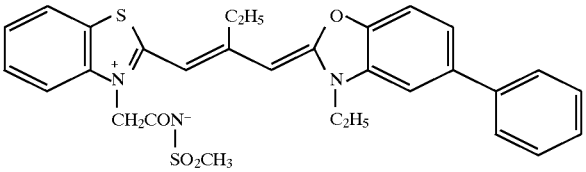
red sensitizing dye cpd 13
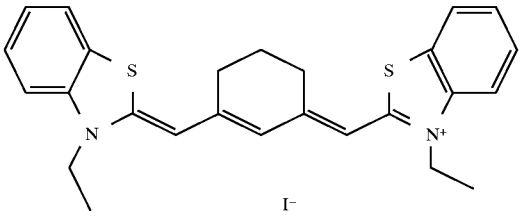
cyan coupler C-2
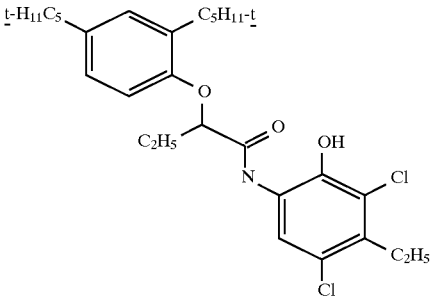
blue sensitizing dye cpd 14
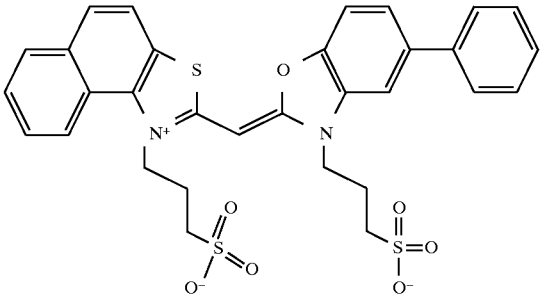
$(CH_3CH_2)_3NH^+$
blue sensitizing dye cpd 15
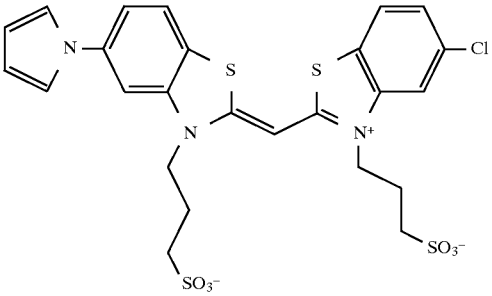
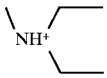

-continued yellow coupler Y-2

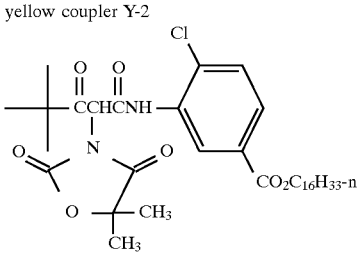

antihalation filter dye cpd 16

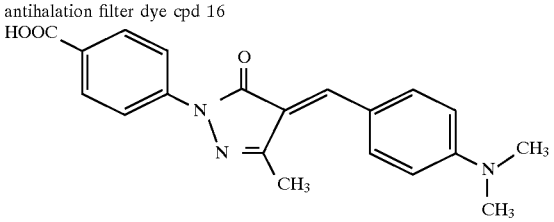

antihalation filter dye cpd 17

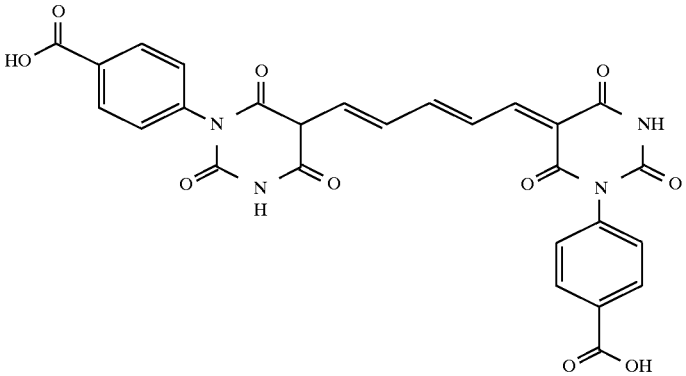

While the invention has been described in detail with particular reference to preferred embodiments, it will be understood that variations and modifications can be effected within the spirit and scope of the invention.

We claim:

1. A silver halide light sensitive photographic print element comprising a support bearing on one side thereof: a blue color sensitive record comprising at least one blue-sensitive silver halide emulsion yellow-image forming layer, a red color sensitive record comprising at least one red-sensitive silver halide emulsion cyan-image forming layer, and a green color sensitive record comprising at least one green-sensitive silver halide emulsion magenta-image forming layer; wherein the overall contrast (OC) of the green record is greater than 1.9, and the mid-scale contrast (MSC) of the green record is about 3.2 or greater, wherein the parameter OC for each ol the color records is defined as the slope of a straight line connecting a point B and a point C on the characteristic curve of Equivalent Neutral Density versus log Exposure for the color record, where points B and C are located by defining a point A on the characteristic curve at the log Exposure required to attain a density level of 1.0, and points B and C are located on the characteristic curve at exposure values −1.1 log Exposure and +0.9 log Exposure with respect to point A, respectively, and the parameter MSC is defined as the slope of a straight line connecting a point D and a point E on the characteristic curve for the color record, where points D and E are located at exposure values −0.2 log Exposure and +0.2 log Exposure with respect to point A, respectively.

2. A color photographic print element according to claim 1, wherein the green color record has an OC value greater than or equal to 2.0.

3. A color photographic print element according to claim 1, wherein the green color record has an OC value greater than or equal to 2.2.

4. A color photographic print element according to claim 1 wherein the red and blue color records have OC values which are at least 90% of the green color record OC value.

5. A color photographic print element according to claim 1 wherein the red and blue color records have MSC values within 10% of the green color record MSC value.

6. A color photographic print element according to claim 1 wherein each of the red, green and blue color records has an OC value of at least 1.9.

7. A color photographic print element according to claim 1 wherein each of the red, green and blue color records has an OC value of at least 2.0.

8. A color photographic print element according to claim 1 wherein each of the red, green and blue color records has an OC value of at least 2.1.

9. A color photographic print element according to claim 1, having an effective ISO speed rating of less than about 10.

10. A color photographic print element according to claim 1, wherein the silver halide of each of at least one of the blue-sensitive, red-sensitive, and green-sensitive silver halide emulsion layers comprises silver chloride emulsion grains or silver bromochloride emulsion grains comprising greater than 50 mole % chloride.

11. A color photographic print element according to claim 10, wherein the silver chloride emulsion grains and silver bromochloride emulsion grains of each layer have an average equivalent circular diameter of less than 1 micron and an aspect ratio of less than 1.3.

12. A color photographic print element according to claim 10, wherein each of the red-sensitive and green-sensitive silver halide emulsion layers comprise emulsion grains having an average equivalent circular diameter of less than 0.60 micron, and the blue-sensitive silver halide emulsion layer comprises emulsion grains having an average equivalent circular diameter of less than 0.90 micron.

13. A process of forming an image in a motion picture silver halide light sensitive photographic print element comprising: (a) digitally exposing a photographic light sensitive element according to digital image data using a digital film recording device to form a color negative film record, and printing the negative film record on the silver halide light sensitive photographic print element to form an exposed print element, or (b) directly exposing the silver halide light sensitive photographic print element according to digital image data with a digital film recording device; and processing the exposed photographic print element resulting from (a) or (b) to form a developed image;

wherein the print element comprises a support bearing on one side thereof: a blue color sensitive record comprising at least one blue-sensitive silver halide emulsion yellow-image forming layer, a red color sensitive record comprising at least one red-sensitive silver halide emulsion cyan-image forming layer, and a green color sensitive record comprising at least one green-sensitive silver halide emulsion magenta-image forming layer; and wherein the overall contrast (OC) of the green record is greater than 1.9, wherein the parameter OC for each of the color records is defined as the slope of a straight line connecting a point B and a point C on the characteristic curve of Equivalent Neutral Density versus log Exposure for the color record, where points B and C are located by defining a point A on the characteristic curve at the log Exposure required to attain a density level of 1.0, and points B and C are located on the characteristic curve at exposure values −1.1 log Exposure and +0.9 log Exposure with respect to point A, respectively.

14. A process according to claim 13, wherein the green color record of the print element has an OC value greater than or equal to 2.0.

15. A process according to claim 13, wherein the green color record of the print element has an OC value greater than or equal to 2.2.

16. A process according to claim 13 wherein the red and blue color records of the print element have OC values which are at least 90% of the green color record OC value.

17. A process according to claim 13 wherein the mid-scale contrast (MSC) of the green record of the print element is about 3.2 or greater, wherein the parameter MSC is defined as the slope of a straight line connecting a point D and a point E on the characteristic curve for the color record, where points D and E are located at exposure values −0.2 log Exposure and +0.2 log Exposure with respect to point A, respectively, and the digital image data used to expose the color negative film record or directly expose the print element is modified to compensate for the MSC value of the print element.

18. A process according to claim 17 wherein the red and blue color records of the print element have MSC values within 10% of the green color record MSC value.

* * * * *